US008684062B2

(12) United States Patent
Ng

(10) Patent No.: US 8,684,062 B2
(45) Date of Patent: Apr. 1, 2014

(54) ROLLER BLIND CONTROL MECHANISM

(76) Inventor: Philip Ng, Thornhill (CA)

( * ) Notice: Subject to any disclaimer, the term of this patent is extended or adjusted under 35 U.S.C. 154(b) by 0 days.

(21) Appl. No.: 13/587,112

(22) Filed: Aug. 16, 2012

(65) Prior Publication Data

US 2014/0048218 A1 Feb. 20, 2014

(51) Int. Cl.
*E06B 9/17* (2006.01)

(52) U.S. Cl.
USPC ..... 160/23.1

(58) Field of Classification Search
USPC ..... 160/23.1, 41, 66, 273.1, 133, 370.22, 160/11
See application file for complete search history.

(56) References Cited

U.S. PATENT DOCUMENTS 2,354,832 A * 8/1944 Ristine ..... 160/11
2,383,015 A * 8/1945 Pratt ..... 160/267.1
3,882,921 A * 5/1975 Sandall ..... 160/266
3,965,960 A * 6/1976 Massey ..... 160/295
4,168,734 A * 9/1979 Holmqvist et al. ..... 160/23.1
4,197,896 A * 4/1980 Reichstadt ..... 160/107
4,317,480 A * 3/1982 Phelps ..... 160/23.1
6,230,782 B1 * 5/2001 Reichert ..... 160/32
6,873,461 B1 * 3/2005 McPherson, Jr. ..... 359/461
7,500,505 B2 * 3/2009 Smith et al. ..... 160/120
7,617,858 B2 * 11/2009 Hoffmann et al. ..... 160/11
7,806,160 B2 * 10/2010 Byeon ..... 160/85

* cited by examiner

*Primary Examiner* — David Purol
(74) *Attorney, Agent, or Firm* — Elias C. Borges

(57) ABSTRACT

Here is disclosed a stopper for stopping the upward movement of a bottom bar attached to a fabric blind wound on a roller tube mounted within an elongated chamber of an elongated housing having a vertical wall. The stopper includes an elongated member having a head portion, a toe portion and a neck portion between the head and toe portion. The head portion is mountable within a mounting cavity positioned on the elongated housing adjacent the vertical wall. The mounting cavity, head portion and neck portion are dimensioned and configured to position the toe portion between the vertical wall and the roller tube when the stopper is mounted to the housing. The toe portion has a multi-position spacer element for selectively positioning the toe portion between proximate and distal positions relative to the vertical wall.

10 Claims, 5 Drawing Sheets

ROLLER BLIND CONTROL MECHANISM

FIELD OF THE INVENTION

The invention relates generally to roller blinds, and in particular to devices for controlling the raising and lowering of a roller blind having a bottom bar.

BACKGROUND OF THE INVENTION

Roller blinds are a popular form of window treatment which is useful in controlling the amount of light passing through the window. Roller blinds consist of a fabric blind wrapped around a roller tube which is mounted at the top of the window and usually contained within some sort of elongated roller tube housing having a decorative front fascia. A control mechanism is generally provided for raising and lowering the fabric blind by rotating the roller tube. A bottom bar is often mounted at a bottom end of the fabric blind in order to weigh down the end of the blind and to provide an aesthetically pleasing finish to the bottom edge of the blind.

One of the existing problems with many roller blind control mechanisms currently on the market is the likelihood that a user can raise the blind too much and cause the bottom bar to jam into the roller tube housing. In order to prevent this, it is possible to design the roller tube housing to narrow the space through which the blind passes in order to block the bottom bar from entering the housing. However, while potentially effective, a narrow opening for allowing the fabric to pass through makes the roller blind more complicated to install. An improved mechanism for stopping the upward moving of the bottom bar is therefore desirable.

SUMMARY OF THE INVENTION

In accordance with one aspect of the present invention, there is provided stopper for stopping the upward movement of a bottom bar attached to a fabric blind wound on a roller tube mounted within an elongated chamber of an elongated housing having a vertical wall. The stopper includes an elongated member having a head portion, a toe portion and a neck portion between the head and toe portion. The head portion is mountable within a mounting cavity positioned on the elongated housing adjacent the vertical wall. The mounting cavity, head portion and neck portion are dimensioned and configured to position the toe portion between the vertical wall and the roller tube when the stopper is mounted to the housing. The toe portion has a multi-position spacer element for selectively positioning the toe portion between proximate and distal positions relative to the vertical wall.

In accordance with another aspect of the present invention, there is provided a roller blind control mechanism for raising and lowering a fabric blind having a bottom bar mounted to a lower edge of the fabric blind. The control mechanism includes an elongated roller tube for winding up the fabric blind An elongated housing for containing the roller tube within an elongated chamber, the elongated housing having a top wall and first and second walls depending from the top wall, the first, second and top walls enclosing the elongated chamber, the housing having a lower opening extending between the roller tube and the second wall through which the fabric blind passes. The control mechanism also includes a stopper for blocking the bottom bar from entering the elongated chamber, the stopper having a head portion, a toe portion and a neck portion connecting the head and toe portions. The head portion is mounted to the top wall of the housing adjacent the second wall. The neck portion is dimensioned and configured such that the toe portion extends downwardly and is positioned in the lower opening. The toe portion is dimensioned and configured to block passage of the bottom bar between the roller tube and the second wall. The toe portion has a multi-position spacer element for positioning the toe portion between proximate and distal positions relative to the second wall.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
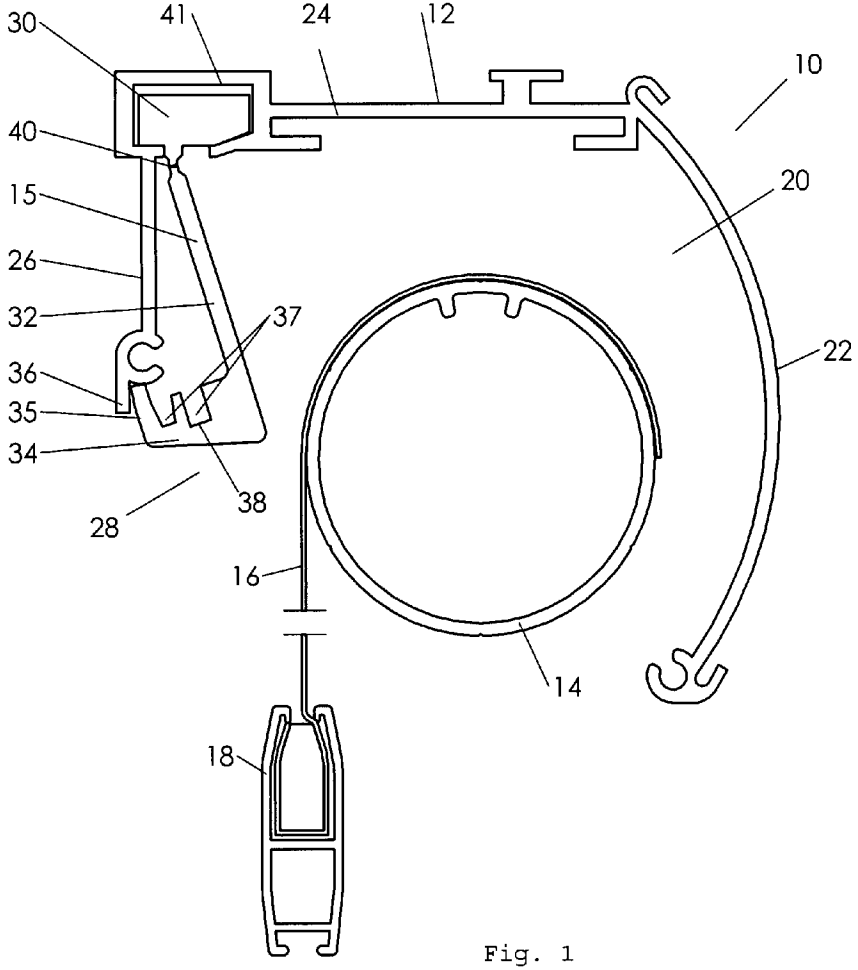
FIG. 1 is a side view of a roller blind control mechanism made in accordance with the present invention showing the stopper in its distal position.

Referring to FIG. 1, a control mechanism made in accordance with the present invention is shown generally as item 10, and includes elongated housing 12, roller tube 14 and stopper 15. Housing 12 has front fascia 22, top wall 24 and back wall 26 enclosing elongated chamber 20. Roller tube 14 is mounted within elongated chamber 20 and positioned between fascia 22 and back wall 26. Blind 16 is wrapped around roller tube 14 and one end of the blind is weighted down with bottom bar 18. It will be appreciated that the overall diameter of roller tube 14 will be increased because a quantity of blind will be wrapped around the roller tube. Blind 16 extends through bottom opening 28 of housing 12. Stopper 15 is mounted to housing 12 and includes head portion 30, toe portion 34 and neck 32. Head portion 30 is block shaped and is dimensioned and configured to be retained in mounting cavity 41 formed on top wall 24 adjacent back wall 26. Neck portion 32 and toe portion 34 are dimensioned and configured such that toe portion 34 is positioned to obstruct opening 28 and block bottom bar 18 from entering chamber 20 in the event roller tube 14 is rotated to lift blind 16 excessively. The actual dimensions of toe portion 34 is selected to obstruct opening 28 taking into account the fact that the diameter of roller tube 14 is increased because of the quantity of blind fabric wrapped around the roller tube.

Figure 2:
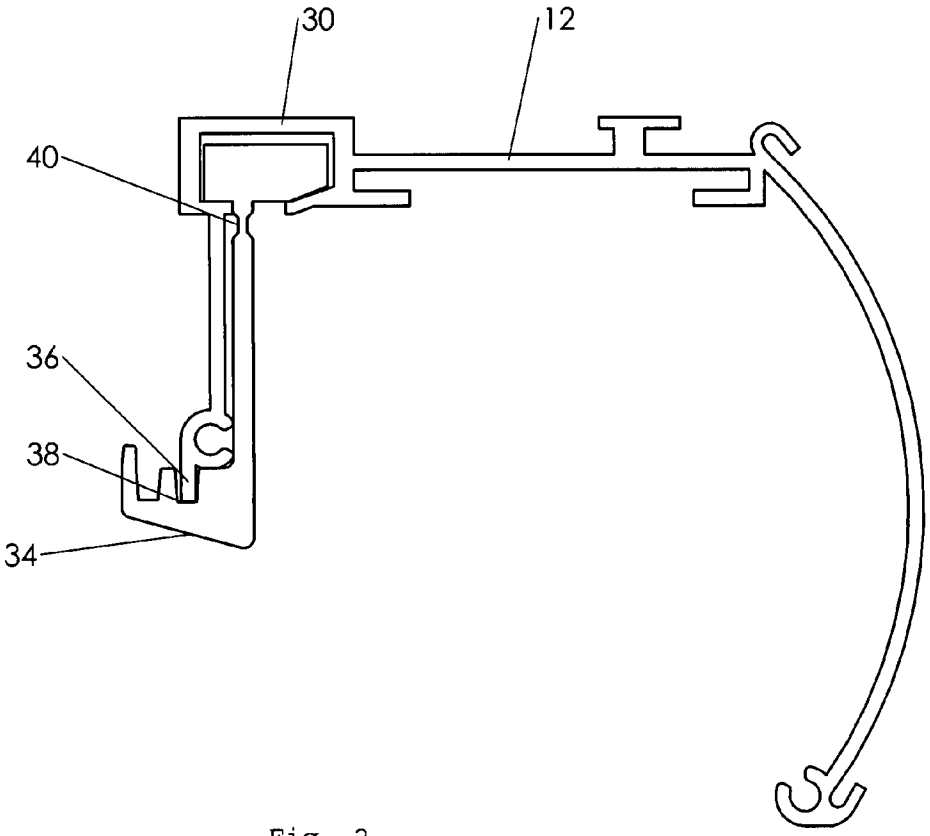
FIG. 2 is a side view of a roller blind control mechanism made in accordance with the present invention showing the stopper in its proximal position.

Toe portion 34 has a multi-position spacer feature 38 consisting of a plurality of parallel grooves 37 and lip 35, each groove dimensioned to receive lower edge 36 of back wall 26. Lip 35 consists of a raised ridge formed on toe portion 34 which is dimensioned to bear against lower edge 36 to position the toe portion closer to roller tube 14. Neck 32 has a joint portion 40 which is relatively thin. Stopper 15 is preferably made of a highly resilient plastic and neck 32 and joint 40 are dimensioned to permit the neck to flex such that toe portion can be moved between a distal position as shown in FIG. 1 to a proximal position as shown in FIG. 2. Preferably, stopper 15 is made of a plastic such as nylon which is sufficiently resilient such that joint 40 biases toe portion 34 towards it proximal position. With neck 32 biasing toe portion 34 towards back wall 26, there is less likelihood that the toe portion will interfere with the operation of roller tube 14.

Figure 3:
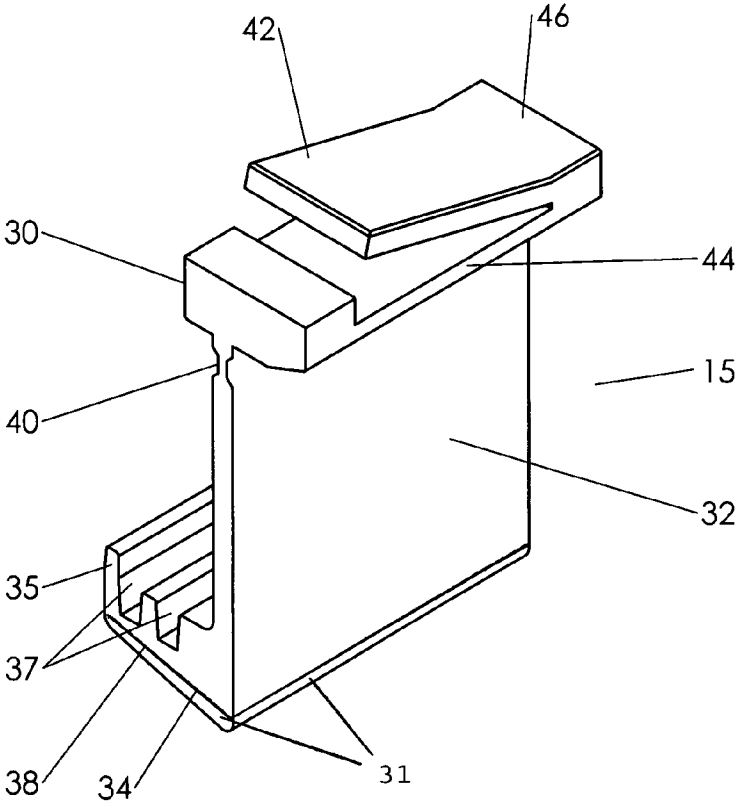
FIG. 3 is a perspective view of the stopper portion of the present invention.

Referring now to FIG. 3, stopper 15 is essentially an "L" shaped member with toe portion 34 positioned below head 30. Toe portion 34 has multi-position spacer 38 which includes a plurality of grooves 37 and lip 35. Joint 40 forms a portion of neck 32 and is sufficiently thin to permit the neck to flex. Head portion 30 has a spring arm 42 formed thereon which is pivotally movable and biased towards an extended position as shown in FIG. 3. Spring arm 42 is movable towards a retracted position wherein the spring arm is flat against flat portion 44 of the head portion. Preferably stopper 15 is injection molded from a resilient plastic such as nylon, thereby forming arm 42 as a spring biased towards its extended position. A rubber layer 31 may be formed on toe portion 34 to act as a vibration dampener to muffle vibrations and sound caused by the bottom bar impacting the stopper. A leader portion 46 of head portion 30 is flat, with arm 42 being angled away from it.

Figure 4:
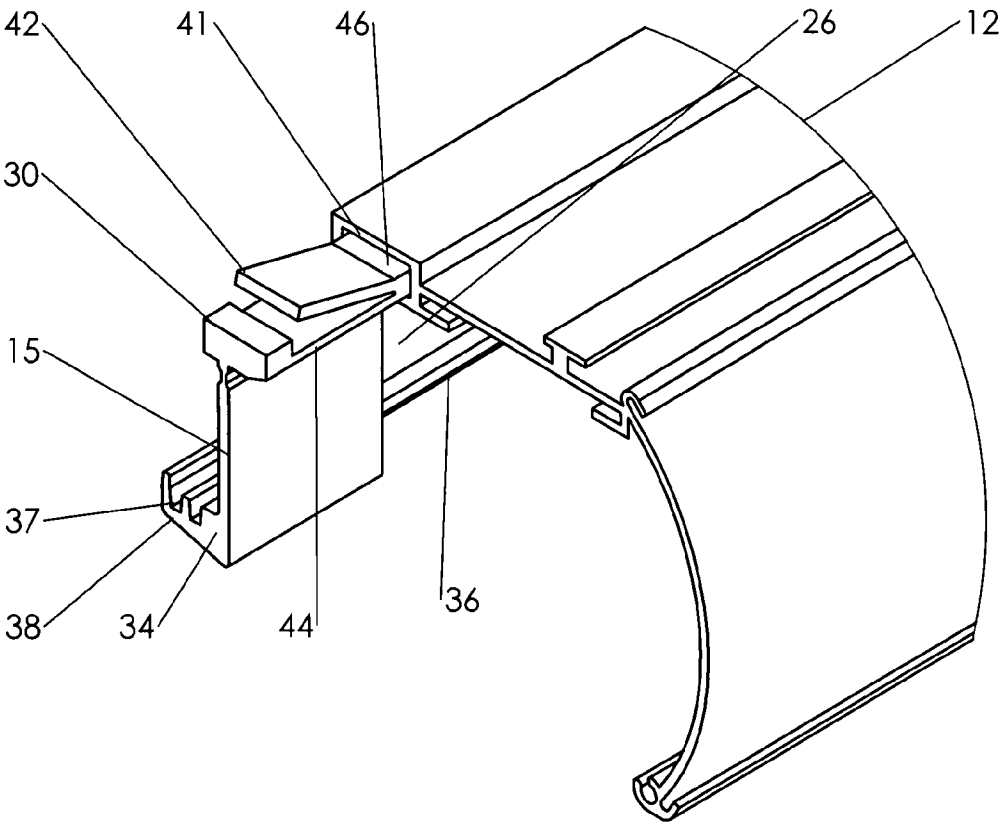
FIG. 4 is a perspective view of the stopper portion of the present invention being inserted into the mounting cavity of the housing portion of the invention and showing the spring arm in its extended position.
Figure 5:
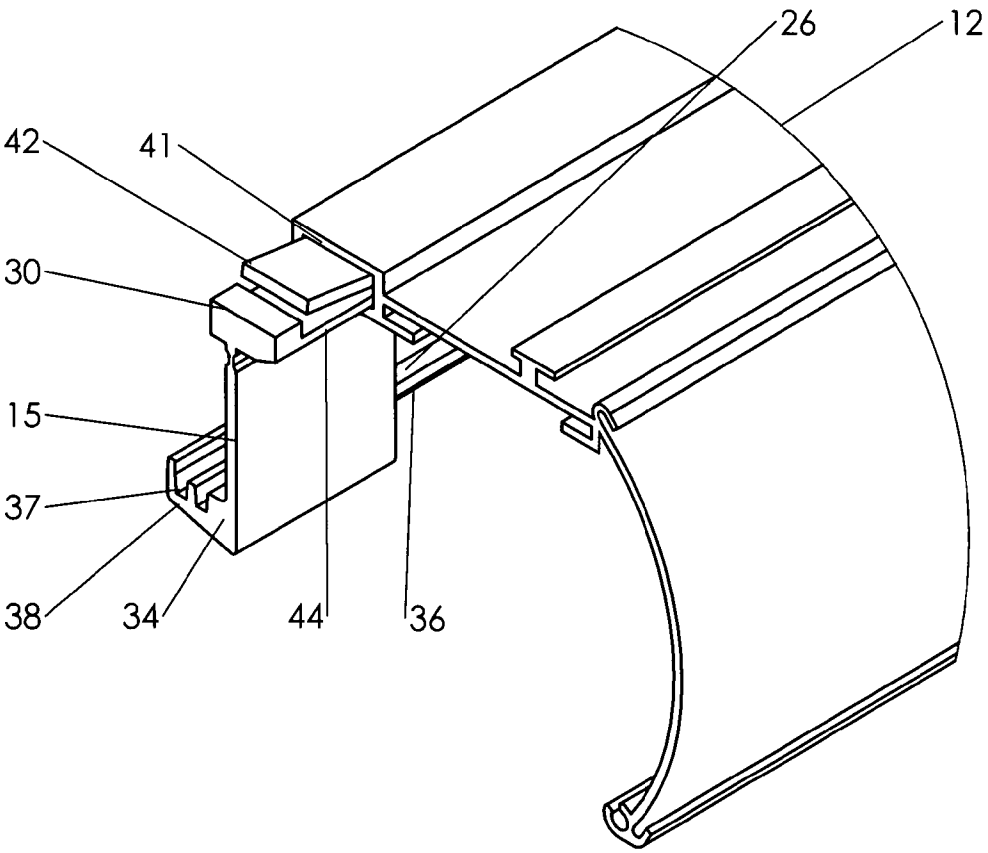
FIG. 5 is a perspective view of the stopper portion of the present invention being inserted into the mounting cavity of the housing portion of the invention and showing the spring arm being moved towards its retracted position.

Referring now to FIGS. 4 and 5, stopper 15 is mounted to housing 12 by inserting leader portion 46 of head portion 30 into mounting cavity 41. Before inserting the stopper into the mounting cavity, the stopper is aligned with housing 12 such that head portion 30 is aligned with mounting cavity 41 with leader portion 46 oriented towards the mounting cavity. At the same time as head portion 30 is aligned with mounting cavity 41, toe portion 34 is angled such that multi-position spacer portion 38 is aligned with bottom edge 36 of back wall 26 to enable the bottom edge to engage one of the grooves 37. When properly aligned, stopper 15 is then urged towards housing 12. With spring arm 42 in its extended position, head portion 30 is too large to fit within mounting cavity 41; however, orientating the spring arm such that it is pointed away from housing 12 makes it easier to insert head portion 30 by depressing the spring arm as stopper 15 is being inserted. Spring arm 42 moves towards its retracted position as head portion 30 is inserted into mounting cavity 41 when stopper 15 is urged towards housing 12 with sufficient force. Since spring arm 42 is biased towards its extended position, the spring arm acts to hold head portion 30 tightly in mounting cavity 41.

Referring back to FIG. 1, the present invention has several advantages. Firstly, the stopper can be used with roller tube housings having different sizes or with blinds having roller tubes of different diameters. Since toe portion 34 has a multi-position spacer 38, the toe portion can be placed in several different positions relative to the roller tube. Hence, in the event that a larger diameter roller tube is used, it is possible to place stopper 15 towards its proximal position wherein the toe portion is closer to back wall 26. If a smaller diameter roller tube is used, it is possible to place toe portion it its distal position, where the toe portion is closer to the roller tube. Since the stopper is attached to the housing, it is possible to first install the roller tube through the large and unobstructed bottom opening 28 before attaching stopper 15. This makes installation easier. It also allows for the same housing to be used with roller tubes of different diameters, simply by adjusting the position of stopper 15.

Since the overall diameter of the roller tube is also a function of how much fabric is wrapped around the roller tube (i.e. the length of the blind), multi-position spacer 38 can be used to adjust the position of toe portion 34 where more or less fabric is wound around the roller tube. The present invention permits the same stopper mechanism to be used regardless of the length or thickness of the blind material, because the final position of the toe portion can be quickly adjusted.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A roller blind control mechanism for raising and lowering a fabric blind, the fabric blind having a bottom bar mounted to a lower edge of the fabric blind, the control mechanism comprising;

a. An elongated roller tube for winding up the fabric blind;

b. An elongated housing for containing the roller tube within an elongated chamber, the elongated housing having a top wall and first and second walls depending from the top wall, the first, second and top walls enclosing the elongated chamber, the housing having a lower opening extending between the roller tube and the second wall through which the fabric blind passes;

c. A stopper for blocking the bottom bar from entering the elongated chamber, the stopper having a head portion, a toe portion and a neck portion connecting the head and toe portions, the head portion mounted to the top wall of the housing adjacent the second wall, the neck portion being dimensioned and configured such that the toe portion extends downwardly and is positioned in the lower opening, the toe portion being dimensioned and configured to block passage of the bottom bar between the roller tube and the second wall;

d. The toe portion having a multi-position spacer element for positioning the toe portion between proximate and distal positions relative to the second wall.

2. A roller blind control system as defined in claim 1 wherein the second wall has an edge adjacent the lower opening, the multi-position spacer comprising a plurality of grooves formed on the toe portion, each of the grooves configured to engage said edge.

3. A roller blind control system as defined in claim 1 wherein the neck portion of the stopper is sufficiently flexible and resilient such that the toe portion is biased towards its proximate position.

4. A roller blind control system as defined in claim 2 wherein the neck portion of the stopper is sufficiently flexible and resilient such that the toe portion is biased towards its proximate position.

5. A roller blind control system as defined in claim 4 wherein the stopper is made of a resilient plastic and wherein a flexible joint is formed on the neck between the toe and head portions, the flexible joint comprising a thinning of the neck.

6. A roller blind control system as defined in claim 1 wherein the housing includes a mounting cavity formed on the top wall of the housing adjacent the second wall, the mounting cavity and the head portion of the stopper being dimensioned and configured such that the head portion of the stopper fits within the mounting cavity, the mounting cavity having a bottom opening through which the neck of the stopper can pass through.

7. The roller blind control system as defined in claim 6 wherein a resilient spring is formed on the head portion of the stopper, the resilient spring configured to firmly hold the head portion of the stopper within the mounting cavity.

8. The roller blind control system as defined in claim 7 wherein the resilient spring comprises a resilient spring member formed on the head portion, the resilient spring member movable between a retracted position wherein the spring member lies flat against the rest of the head portion to enable the head portion to fit easily within the mounting cavity, and an extended portion wherein the arm extends away from the rest of the head portion, the arm being biased towards its extended position.

9. A roller blind control mechanism for raising and lowering a fabric blind, the fabric blind having a bottom bar mounted to a lower edge of the fabric blind, the control mechanism comprising;

a. An elongated roller tube for winding up the fabric blind;

b. An elongated housing for containing the roller tube within an elongated chamber, the elongated housing having a front fascia, a top wall, and a back wall enclosing the elongated chamber, the housing having a lower opening for allowing the blind to pass there through, the lower opening positioned between the roller tube and the back wall;

c. A stopper for blocking the bottom bar from entering the elongated chamber, the stopper having a head portion, a toe portion and a neck portion connecting the head and toe portions, the head portion mounted to the housing adjacent the back wall, the neck portion being dimensioned and configured such that the toe portion extends downwardly and is positioned in the rearward portion of the lower opening, the toe portion being dimensioned and configured to block passage of the bottom bar between the roller tube and the back wall;

d. The toe portion having a multi-position spacer element for selectively positioning the toe portion between proximate and distal positions relative to the back wall.

10. The roller blind control mechanism as defined in claim 9 wherein the multi-position spacer element comprises a plurality of grooves formed on the toe portion, the grooves each being configured to mount to an edge of the back wall.

* * * * *